United States Patent [19]

Bichot et al.

[11] Patent Number: 4,583,697

[45] Date of Patent: Apr. 22, 1986

[54] CONTROLLED COMPRESSION WINDING METHOD AND APPARATUS

[75] Inventors: Bernard Bichot, Clermont; Henri Lemaignen, Chantilly; Bernard Louis, Liancourt, all of France

[73] Assignee: Isover Saint-Gobain, Courbevoie, France

[21] Appl. No.: 663,401

[22] Filed: Oct. 22, 1984

[30] Foreign Application Priority Data

Oct. 21, 1983 [FR] France ..... 83 16758

[51] Int. Cl.[4] ..... B65H 18/08; B65H 18/22; B65H 18/26

[52] U.S. Cl. ..... 242/55.1; 242/67.1 R; 242/67.5; 242/DIG. 3

[58] Field of Search ..... 242/55.1, 66, 67.1, 242/67.5, 75.1, 75.51, DIG. 3; 100/5, 40, 76, 88

[56] References Cited

U.S. PATENT DOCUMENTS

| | | | |
|---|---|---|---|
| 2,353,821 | 7/1944 | Fourness et al. | 242/67.1 R |
| 2,881,984 | 4/1959 | Dyken | 242/DIG. 3 |
| 3,098,619 | 7/1963 | Washburn | 242/66 |
| 3,964,246 | 6/1976 | Kopaska | 100/88 X |
| 4,025,009 | 5/1977 | Fineo | 242/66 |
| 4,238,084 | 12/1980 | Kataoka | 242/75.51 |
| 4,256,269 | 3/1981 | Feighery et al. | 242/66 |

FOREIGN PATENT DOCUMENTS

| | | | |
|---|---|---|---|
| 2751257 | 5/1978 | Fed. Rep. of Germany | 242/DIG. 3 |

*Primary Examiner*—Stanley N. Gilreath

*Attorney, Agent, or Firm*—Oblon, Fisher, Spivak, McClelland & Maier

[57] ABSTRACT

A method and apparatus for forming rolls of compressible materials such as a mineral wool felt, wherein the felt is rolled up in a space defined by a pair of conveyors and a compression roll. The position of at least one of these elements, particularly the compression roll, is varied during the course of winding, according to a preset program and as a function of the length of felt already rolled, in such a way as to produce a predetermined thickness in each turn of the rolled felt, whereby it is possible to achieve particularly more uniform compression over the entire length of the rolled up felt strip.

10 Claims, 7 Drawing Figures

CONTROLLED COMPRESSION WINDING METHOD AND APPARATUS

BACKGROUND OF THE INVENTION

1. Field of the Invention

This invention relates to techniques of preparing products, such as mineral wool felts, which by reason of their resilience are of low volumetric mass and are advantageously compressed during storage and transportation.

2. Description of the Prior Art

In the conventional packaging of lightweight felts a lightweight felt is rolled onto itself and thereby compressed. In this way, cylindrical rolls are formed, the stability of which is guaranteed by the wrapping which is normally a sheet of paper or a sheet of polymeric material.

With regard to bulk, if it is advantageous to compress the felt considerably, the rate of compression chosen must also take into account the product's capacity to resume its thickness when used. The qualities of felts, particularly their insulating qualities, indeed depend upon their thickness. Experience shows that to ensure a satisfactory restoration of thickness when the product is no longer compressed, it is necessary to limit the rates of compression imposed.

The best possible way of rolling up these products is to use a method which, by ensuring uniform compression over the entire length, makes it possible to work at the highest acceptable rate of compression without compromising the quality of the procuct. Also, rolling up the felt guarantees the quality of the product in a packaging which offers the minimum of bulk.

Various means have been proposed in order to arrive at this result.

Typically, the felt is conveyed into a space defined by two conveyor belts and a compression roller. These belts and this roller entrain the felt into a rotational movement terminating in its being wound onto itself. The compression roller may move in such a way as progressively to enlarge the space in which the felt is being rolled up.

In order to arrive at a uniform compression of the felt, it is necessary for the pressure exerted by the compression roller to grow with the number of turns of felt rolled. The law of increase in pressure to be applied depends on numerous parameters.

Hitherto, the means used for increasing the pressure exerted have not been entirely satisfactory.

In the typical conventional construction, the increase in pressure exerted results directly from the increase in the "diameter" of the felt rolled up. For example, the compression roller is disposed on the end of a movable arm. The roll of felt, as it grows, pushes back the compression roller. A pneumatic jack fixed on the arm carrying the compression roller exercises a reaction which tends to oppose the movement of the arm. The pressure in the pneumatic jack which is transmitted through the arm and the compression roller to the felt while the felt is being rolled up is all the greater as the displacement of the compression roller becomes greater.

Even when such means are refined, it is not possible in practice satisfactorily to follow the progression necessary to ensure a uniform rate of compression of the felt over its entire length. Typically, it is found more often than not that compression is much higher in the center of the roll in comparison with that which is exerted on parts situated at the periphery. Having regard to the necessity of the roll resuming its thickness, the tendency is to reduce the compression over the whole of the roll. Consequently, the prepared products are either less long or more bulky than would be necessary if one were perfectly to control the handling and preparation of the felt.

On the other hand, an additional difficulty results from the need, in certain installations, to treat varied products having characteristic features, particularly vis-a-vis compression, which may be vastly different from one another. Under these conditions, at every change in production, it is necessary to modify the mechanical arrangements, which necessitates relatively long and delicate adjustment.

SUMMARY OF THE INVENTION

Accordingly, one object of this invention is to provide a novel method and apparatus for forming rolls from strips of compressible material, whereby it is possible to provide a more uniform rolling of products over their entire length.

Another object of this invention to provide such a novel method and apparatus which are conveniently adaptable to the handling of varied products.

These and other objects are achieved according to the invention by providing a novel method and apparatus wherein the compression exerted on the felt does not result from a passive reaction, but instead results from a movement of the compression elements according to a program which is clearly determined by the operator. To this end, the compression elements are associated with a motor capable of ensuring a modification of their relative disposition so that at any time during the course of rolling of the felt the space left available between these elements determines for each turn a clearly defined compressed thickness which is a function of the length of felt already rolled.

The motor for ensuring displacement of the compression elements is controlled by a controller associated with measuring devices and computing devices whereby this displacement is carried out according to a predetermined program.

The computing devices establish operating instructions for the motor means according to various variable parameters of the installation. At least one of these parameters is measured directly by appropriate measuring devices during operation and is transmitted to the computing devices for processing. Other variable instructions may also be introduced by the operator.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
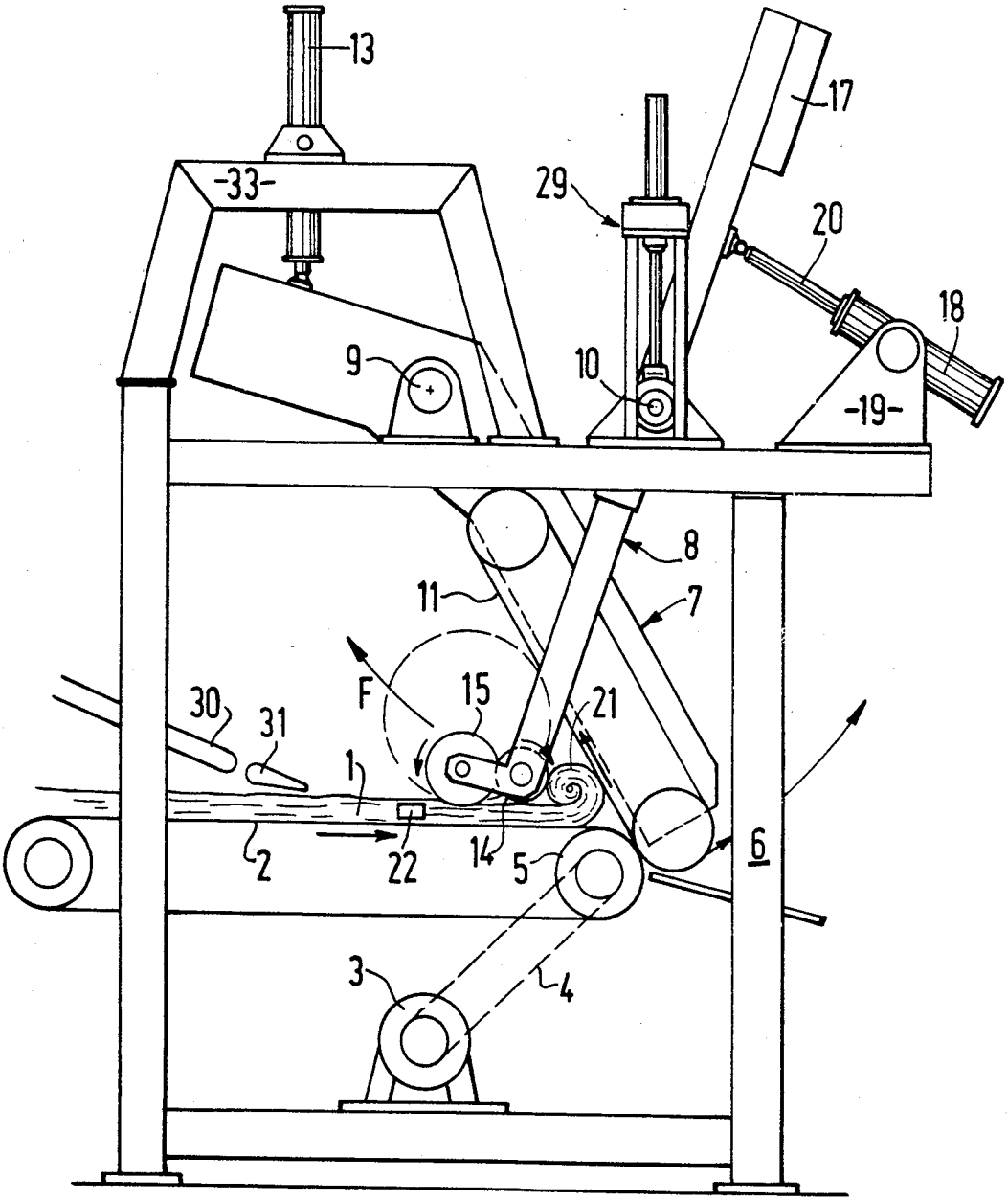
FIG. 1 is a schematic side view of a winding machine such as that used according to the invention.

Referring now to the drawings, wherein like reference numerals designate identical or corresponding parts throughout the several views, and more particularly to FIG. 1 thereof, the winding machine shown in FIG. 1 may be used for forming rolls of glass wool felt or similar compressible products.

This winding machine may be disposed directly at the end of a production line turning out these felts. The manner in which the fibers are produced is not of importance to the invention. It is sufficient, particularly after the stage of polymerising the binder which causes the fibers to adhere to one another, for the felt thus made up to exhibit satisfactory resilience, in other words for it to be able to undergo considerable compression and then resume the major part of its initial thickness when it ceases to be compressed.

Needless to say, of the mineral felts, only those which are qualified as "light" themselves to this method of packaging. For volumetric masses in excess of 30 kg/cu.m and thicknesses in excess of 20 mm, even if the packaging comprises a certain compression, this can only be exerted on flat products. In the same way, felts covered on at least one of their faces can be rolled up on condition that the covering is capable of undergoing considerable flexion without damage. This is particularly the case with kraft papers, coverings of polymeric material films, aluminized or not, and generally speaking thin and flexible coverings.

The felt 1 progresses on the conveyor 2 in the direction indicated by the arrow. The conveyor 2 is caused to move by the motor 3 through a belt 4 and a drive drum 5.

A chassis 6, straddling the conveyor 2, supports two arms 7 and 8. These arms are movable in rotation respectively about spindles 9 and 10 carried by bearings fixed on the chassis 6.

The arm 7 carries a conveyor 11 of which the end most remote from the spindle 9 is situated opposite the end of the conveyor 2, at a short distance therefrom. This distance is as small as possible. Its object is to facilitate starting off the winding process by allowing the felt a minimum of space. This distance must, however, be adequate to avoid any risk of the conveyors rubbing on each other.

The conveyor 11 is on the inside of a casing which is shown only partially in the drawings for reasons of clarity. The limits of the missing part of the casing are indicated by dotted lines.

In this position, the faces of the conveyors make an angle smaller than 90° between them. This angle is advantageously between 40° and 80° and is preferably close to 60°.

The conveyor 11 is caused to move by the motor 3, through a deformable articulated transmission, not shown. This articulated transmission is such that it allows the arm 7 to rock in the manner described hereinafter.

A jack 13 fixed on a support 33 rigid with the chassis 6 makes it possible to rock the arm in order to move the end of the conveyor 11 away from that of the conveyor 2. In the apart position, the distance separating the two conveyors is greater than the diameter of the rolls of felt formed, to allow these latter to be removed.

The supply to and operation of the jack 13 are now described.

The arm 8 comprises two identical parts situated on either side of the arm 7 which they frame.

The bottom ends of the two parts of the arm 8 carry two rollers 14 and 15. These rollers are caused to rotate by chains, not shown, situated along the arm itself. The drive is provided by the motor 3. The wheels for returning the movement of the chains are coaxial with the axis of rotation 10 of the arm 8 so that a displacement of the arm 8 can be carried out without altering the tension of the chains. A speed varying device, not shown, is incorporated into the transmission system.

The arm 8 is extended by a counterweight 17 which balances the arm 8 and renders its movement easier.

In a preferred embodiment according to the invention, the space in which the strip of felt is rolled up is defined by two conveyors and one roller. As is necessary, at least one of the conveyors may be replaced by a roller fulfilling the same function. Despite a somewhat more complicated mechanism, the use of conveyors is advantageous for several reasons.

A first reason lies in the fact that even if the rollers are of relatively large size, contact with the rolled up strip occurs over a convex surface which has a tendency to deform the felt more than would a conveyor which has a flat surface. This is important to satisfactory formation of the roll.

It should be noted in passing that the use of large diameter rollers has the drawback of necessitating a rolling up space which is relatively large in the position corresponding to the start of the operation which does not make it possible to control in a perfectly satisfactory manner the conditions imposed throughout the rolling up process.

The use of conveyors is further advantageous for the reason that when using in place of one or two conveyors one or two rollers whose relative positions are fixed, the bearing points of the rolled up felt evolve as a function of the progress of the rolling process. If we depart from an arrangement where the three bearing points are distributed regularly over the circumference of the roll of felt, this evenness disappears very rapidly and maintenance of it is less easily assured.

It is possible to alter the position not only of the roller which, within the scope of the invention is referred to as the compression roller, but also of the assembly of rollers (or conveyors) in relation to one another so that the bearing points remain well distributed, but this requires a complicated mechanism.

It would therefore seem possible to use conveyors whose relative positions can remain fixed. Increasing the diameter of the roll itself is indeed accompanied by a displacement of the bearing points on the conveyors, a displacement which tends to restore a balanced disposition of these bearing points.

The third bearing point on the compression roller moves likewise according to a movement which maintains this satisfactory disposition. Diagrammatically in this ideal disposition, the bearing points are equidistant from one another. In order to approach this disposition, the distance of the compression on roller from the axis of rotation is sufficiently great and the position of this axis is preferably such that displacement occurs substantially according to the bisector of the angle of the two conveyors.

The following description refers only to the case illustrated in FIG. 1, that is to say the case in which the means defining the rolling up space are constituted by two conveyors and one roller.

In prior constructions, a motor device 18 such as a pneumatic jack mounted on a support 19 rigid with the chassis 6 makes it possible to carry out displacement of the arm 8 through its rod 20.

Still in prior constructions, the pneumatic jack fulfils a purely passive role. When the arm 8, pushed back by the rolled up felt 21, pivots about the axis 10, the pressure of the air in the jack increases and, by reaction, the pressure on the felt increases.

According to the invention, movement of the arm 8 and hence the pressure exerted on the felt follow a pre-established program, whereby the position of the arm 8 is precisely defined at every moment.

The motor device 18 according to the invention is advantageously either a hydraulic jack or an electric motor, the position of either of which is controlled. The output of the motor device 18 is chosen to be sufficiently high so that the pressure exerted by the felt is virtually without influence on the operation of the compression roller, in contrast to the operation of the prior art pneumatic jack.

The supply to the hydraulic jack in the case of the invention is performed conventionally by a proportional distributor and a hydraulic set, not shown.

Generally speaking, according to the invention, movement of the arm 8 is a function of the length of felt rolled up, so that the thickness of each turn in the rolled up unit is virtually constant.

The winding machine according to the invention thus at least includes a detector which at any moment determines the length of felt already rolled up, a sensor accurately detecting the position of the arm 8, and a computing device in which the program of displacement of the arm 8 is stored in a memory. The computing device receives signals relative to the length of felt and signals relative to the position of the arm and responds by deriving a positional instruction for the arm, an instruction which is performed by the motor device 18 (hydraulic jack, electric motor) as indicated previously.

Figure 2:
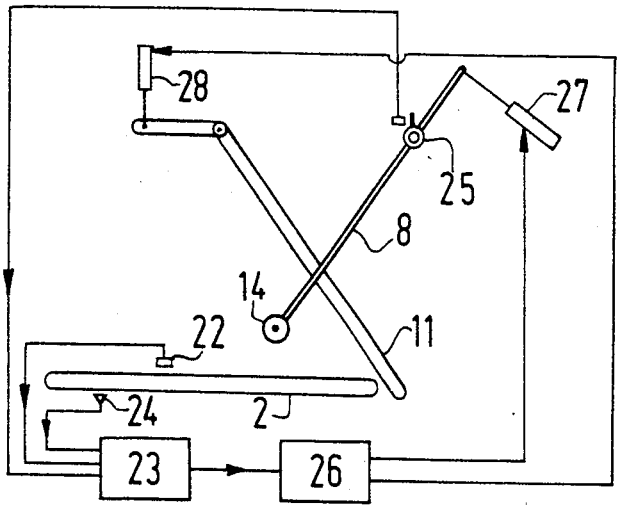
FIG. 2 is a block diagram showing various elements which control the functioning of the winding machine.

A diagram showing the control of the functioning of the winding machine is shown in FIG. 2.

A photoelectric cell 22 disposed above the belt 2 at the entrance to the space in which rolling up occurs detects the arrival of a strip of felt and triggers the start of the control cycle. The signal is transmitted to programmable computing device 23.

The computing device 23 likewise receives from a sensor 24, for example a tachometer, a signal representing the rate of travel of the conveyor 2 and consequently of the felt.

Combination of the felt arrival signal and the felt speed signal indicates the length of felt rolled up.

The computing device 23 also receives a signal emanating from a position coder 25 determining the angle of the arm 8 carrying the compression roller in relation to a reference position.

If applicable, an additional sensor is provided to measure the initial height of the compression roller in relation to the conveyor 2. This determination is needed when the height is altered in order to take account of changes in the thickness of the products being handled.

In FIG. 1, the means which make it possible to alter the initial height of the spindle 10 of the arm 8 are represented at 29. They may, for example, constitute a system driven by a screw motor.

Of course, measurement of the initial height of the arm 8 as that of the speed of the conveyor belt 2 may also be introduced by the operator directly into the data furnished to the computing device. Indeed, these parameters normally remain constant over long periods of operation. Their variations are controlled by the operator who can therefore appropriately amend the data fed into the computing device.

As a function of this data and a control algorithm stored in the memory, the computing device establishes instructions which are passed to controls 26 which control the operation of the motor 27 causing displacement of the compression roller and also the means 28 carrying out displacement of the back conveyor 11.

Operation of the winding machine according to the invention is as follows.

The strip of felt 1 carried be the conveyor 2 passes in front of the photoelectric cell 22 and triggers a measurement of the time lapsed in the operating cycle.

Before entering the space defined for the rolling operation, the strip of felt is compressed by means of the roller 15.

The roller 15 is carried by the arm 8. It is defined in the same way as the compression roller 14 and turns in the opposite direction. The roller 15 makes it possible to avoid the felt coming in contact with the roller 14 when it is introduced into the space in which rolling up takes place. Indeed, the direction of rotation of the roller 14 is such that it would tend to push back the felt instead of facilitating its entry into this space.

The speed of rotation of the roller 15 is so regulated that the speed at the periphery corresponds substantially to that of the conveyor 2.

The felt entrained by the conveyor 2 strikes the back conveyor 11 and is folded back on itself. From the conveyor 11, the end of the felt is directed towards the compression roller 14. The roller 14 constrains the felt again to be bent onto itself. From the roller 14, the end of the felt is sent back towards the conveyor 2 where it comes in contact with the top face of the felt.

Thus, a first loop of felt is formed. The roll then passes through successive thicknesses which become cumulative.

Very soon after the onset of rolling up, the compression roller 14 moves away from its initial position to take into account the increase in volume of the rolled up felt. Displacement occurs in the direction indicated by the arrow F by rocking of the arm 8. The movement is controlled in a programmed fashion to ensure that all the turns of the roll formed are of substantially the same thickness.

It should be noted that the imposed thickness is not necessarily exactly that which is found in the roll of felt. It is indeed necessary to have regard to the elasticity of the product and the deformations which it exhibits during the course of rolling up. In practice, the imposed thickness is generally less than that of the felt in the finished roll, and which is no longer maintained by the conveyors and the compression roller.

As it moves away from its initial position, the arm 8 progressively increases the distance between the conveyor 2 and the roller 15. This distance becomes such that, with effect from a certain moment, the roller 15 ceases to be in contact with the felt. The distance is then likewise sufficient that the felt carried by the conveyor 2 does not come in contact with the compression roller 14.

At the end of the strip of felt 1, a wrapper of paper or polymer is placed on one of the faces of the felt. The length of this wrapper is such that it entirely covers the outer surface of the roll in known manner.

During this time, the roll having achieved its final dimension, displacement of the arm 8 is discontinued.

The wrapper having been placed in position on the felt, packaging of the strip of felt is finished for instance by gluing the wrapper in such a way that it maintains the felt in its final compressed form. The arm 7 moved by the jack 13 rocks. The roll of felt which is entrained by the conveyor 2 is discharged through the orifice left between the conveyors 2 and 11.

At the same time, the arm 8 is restored to its initial position. Finally, the arm 7 is likewise restored to the working position. The winding machine is then ready to process a fresh strip of felt.

The rocking movements of the arm 7 and return of the arm 8 are carried out very rapidly so that the time lapse separating two strips of felt may be very short. In practice, the whole process of ejecting the completed roll and return to the working position does not take more than 2 to 4 seconds.

In these operations, the felt which is maintained compressed does not assume a strictly cylindrical form. It suffers a slight crushing at the points of contact with the conveyors and the compression roller. As above noted, the use of conveyors 2 and 11 makes it possible to maintain a relatively large area of contact, particularly in relation to that of the compression roller 14. This must indeed necessarily show a small radius of curvature in order to be able to define a rolling up space which is of small size at the start of the process.

To minimize deformations of the roll during the course of preparation, it may be advantageous to establish slight differences in speed between, on the one hand, the conveyor 2 and, on the other, the conveyor 11 and the roller 14. By ensuring that the speed of the conveyor 11 and of the roller 14 is slightly greater (generally less than 5%) than that of the conveyor 2, the felt is maintained taut between the successive points of contact and it is possible to avoid the appearance of any substantial deformation which might adversely affect the regularity of rolling.

These slight differences in speed which may exist make it possible to compensate for a possible sliding of the felt on the conveyor 11 or the roller 14, such sliding being, for example, due to the small area of contact.

The system of introducing the wrapper is shown diagrammatically in FIG. 1. The cut and partially glued sheets emanating from a distributor, and controlled likewise by a computing device are carried by a conveyor 30. They then pass onto belts 31 in known manner so that they are deposited on the end of the upper face of the strip of felt at the moment when it is about to enter the rolling up space.

The sheet of wrapper is carried along by the felt. It is taken up from the last turn. This sheet extends beyond the end of the strip of felt over a length greater than that of the periphery of the roll so that it wraps it completely.

As above indicated, displacement of the compression roller follows an algorithm making it possible to guarantee an equal thickness of the turns. In the case shown in FIG. 1, the algorithm chosen is described in the following discussion. The symbols used are those shown in FIG. 3.

Figure 3:
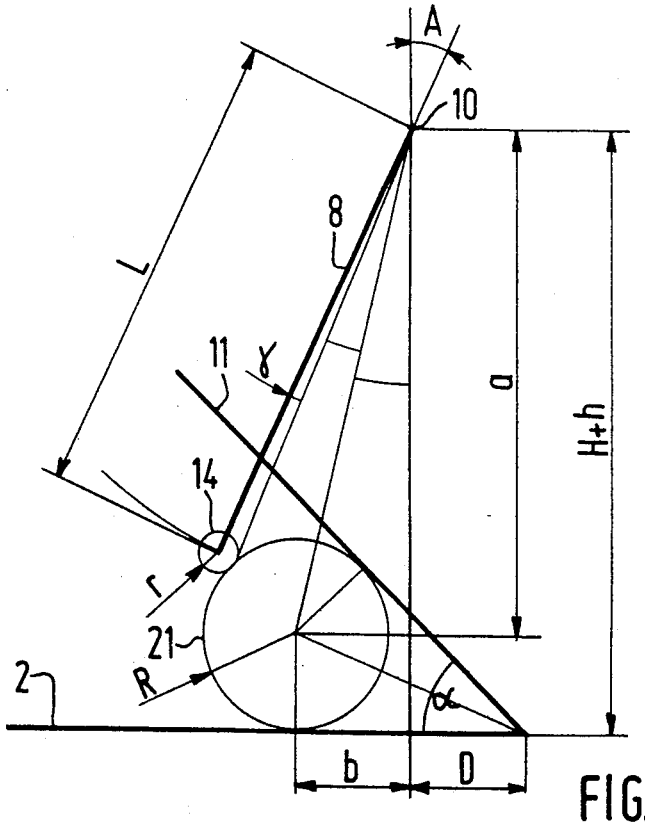
FIG. 3 is a diagram showing various geometric parameters taken into consideration in determining the program for controlling the compression element, in one embodiment of the invention.

FIG. 3 diagrammatically shows the back conveyor 11, the horizontal conveyor 2, the compression roller 14 and the arm 8.

Knowing the final radius R of the formed roll and the length of the fleece of fibers N, it is possible to deduce the thickness E of each turn:

$$E=\pi R^2/N.$$

To have E constant, the movement of the arm 8 carrying the compression roller must be such that at any time the radius r of the roll already made up for a length l of felt is:

$$r=\sqrt{l\cdot E/\pi}\ ,$$

in other words:

$$r=R\sqrt{l/N}\ .$$

A calculation based on the geometry of the system as shown in FIG. 3 makes it possible to express the instantaneous variations in the angle A made by the arm 8 with the vertical. At any moment, the computing device control the position of the arm so that it responds effectively to this condition.

The value of the angle A as a function of the various geometrical parameters is of the type:

$$A = \arccos\left[(L^2+r^2+a^2+b^2-R^2)/2\sqrt{(L^2+R^2)(A^2+B^2)}\ +\ \arctan ba/+\gamma\right]$$

with:

$$a=H+h-R;\ b=R\ \text{cotan}\ \alpha/2-D;\ \gamma=\arctan r/L.$$

In these expressions, the various terms respectively designate:

- L: length of the arm 8 between the axis of rotation and that of the compression roller,
- H+h: distance from the axis of rotation 10 to the conveyor belt 2
- $\alpha$: angle formed by the directions of the two conveyors 2 and 11,
- D: distance separating the point of convergence of the direction of the faces of the conveyors with the projection of the center of rotation of the arm 8 on the face of the conveyor 2.

Of course, this expression of the angle of the arm 8 with the vertical only corresponds to the configuration illustrated. When the various elements constituting the winding machine are in different relative positions, a different expression must be employed as a basis of the program introduced into the computing device. The foregoing expressions are given only by way of illustration of the method employed.

The geometrical conditions which have just been considered constitute only a series of parameters taken into account by the computing device. The principal other parameters are in particular those which depend on the nature of the felt rolled up: initial thickness, total length of the strip, mass per unit of surface area, acceptable rate of compression, etc. The values of these parameters may be introduced directly by the operator or separately or jointly, reference being made to a code to which corresponds the overall set of values stored in the memory, each product having its own code.

The packaging technique according to the invention has been the object of tests on an industrial line producing glass fiber felts.

The felts used are constituted by fibers produced by a centrifugal processing technique. In this technique, the molten material is passed through a centrifuge carrying on its periphery a large number of small diameter orifices. Under the effect of centrifugal force, the material is projected through these orifices and out of the centrifuge in the form of filaments. These fine filaments are further drawn by streams of hot gases travelling at high velocity over the periphery of the centrifuge. The fibers produced are collected on a conveyor. On their way to the conveyor they are coated with a binder. The fibers collected are then passed into a treatment enclosure in which the binder is polymerized. The fleece of fibers thus formed is cut to suitable dimensions, and it is this fleece which is rolled up in the manner described according to the invention.

Ordinarily, in industrial installations, several centrifugal apparata are aligned over one and the same conveyor.

In the tests performed, four or five centrifuges were used simultaneously.

The felts prepared during the course of these tests are relatively light; their volumetric mass ranges from 6.8 kg/cu.m to 10.8 kg/cu.m. The fibers are fine; the micron classification is either 2.5/5 g or 3.1/5 g.

The felts contain 4.5% by weight of binder.

The nominal thickness, that is to say the thickness guaranteed to the user, is 90 mm for all these products. Indeed, in order to take into account incomplete resumption of thickness after storage, an over-thickness is systematically provided for in the felt prior to rolling.

For products which are rolled up in a conventional manner, this over-thickness is all the greater since it must offset the faults in rolling. Indeed, it is necessary to be able to enjoy at least the nominal thickness at all points over the felt after this has been unrolled. To take into account the fact that conventionally the first turns in the roll are more heavily compressed and are less ready to resume their initial thickness, in the prior art techniques, the initial felt must have a considerable over-thickness which may be 60% or more.

By way of comparison, tests have been carried out on the same products for a winding machine according to the invention and on a winding machine of conventional type in which the roll of felt suffers the reaction of a pneumatic jack, the pressure exerted by the compression roller being the greater, the larger is the diameter of the roller of felt.

The following table shows the thicknesses measured after wrapping for products A rolled up in conventional manner after and for products B rolled up according to the technique of the invention. Of course, in both cases the length of the strip of felt and the final diameter of the roll are the same. In this table, the relative offset is also indicated.

For these tests, measurements of thickness was carried out according to French Standard NF-B-20.101. According to this standard, the thickness is measured under a conventional pressure of 50 N/sq.m. Measurements are carried out every 250 mm in the length and 175 mm from the edges in the direction of the width.

The figures shown in the table correspond to the mean of the values measured over the entire length of the strip of felt.

| | Felt | Winder A thickness mm | Winder B thickness mm | % |
|---|---|---|---|---|
| 1 | 10.8 kg/cu.m micron level 3.1/5 g | 102.4 | 113.5 | +10.3 |
| 3 | 8.6 kg/cu.m micron level 3.1/5 g | 100.5 | 106.7 | +6.2 |
| 3 | 9.4 kg/cu.m micron level 2.7/5 g | 86.7 | 99.9 | +15.2 |
| 4 | 10.8 kg/cu.m micron level 2.7/6 g | 87.6 | 100.9 | +15.2 |

In all these examples, it is observed that, all things being equal, rolling up which is carried out under the conditions of the invention permits a substantial increase in resumption of thickness.

Indeed, it is even more remarkable that the thickness of the unrolled product is far more regular over the entire length. The over-compression of the first turns which constitutes a relatively frequent fault in the conventional method of rolling has virtually disappeared. This regularity is particularly advantageous to the extent that it may, for example, lead to a reduction in the thickness of the initial felt or to a greater uniform compression.

Profiles of felts A and B for these four products are shown in FIGS. 4*a* to 4*d*.

The figures shown on the graphs correspond respectively to the averages determined over five equal portions distributed over the entire length of the strip of felt. The results are shown from left to right, the left-hand part representing the end situated at the center of the roll and the right-hand part that which is situated at its periphery.

Figure 4A:
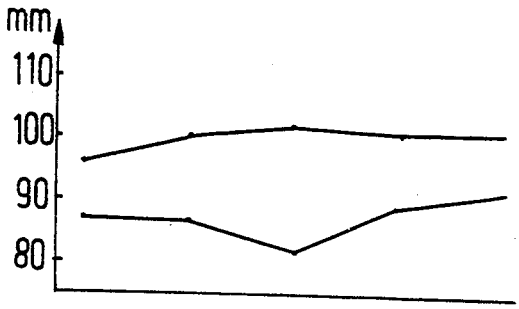
FIGS. 4*a* to 4*d* are diagrams showing the variations in thickness of unpackaged products according to whether they were rolled up by a technique according to the invention or by a conventional technique.
Figure 4B:
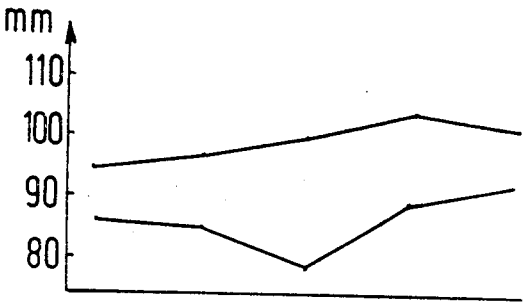
Figure 4C:
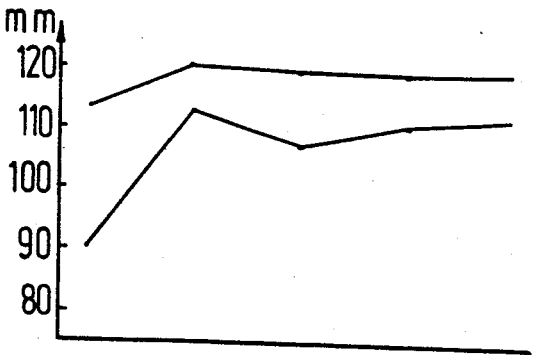
Figure 4D:
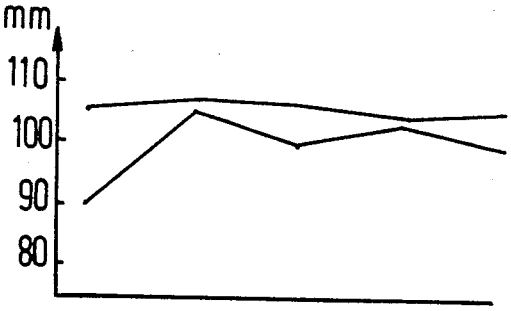

FIGS. 4*a*–4*b* show that uniformity of the product has been considerably improved, and the resumption of thickness is on the whole slightly increased in the part corresponding to the first few turns compared with that for the final turns of the roll. This may possibly be explained by the fact that in the program employed for these tests, the only condition set was a constant thickness of turn. To take into account the radius of curvature which is variable as rolling proceeds and the differences in deformation which result therefrom, it may be preferable to program the rolling operation such that the thickness of the turns decreases slightly from the commencement to the finish of roll forming.

The means proposed according to the invention are also remarkable in that they permit of a very convenient alteration of operating conditions. For this, it is sufficient to alter or complete the program of instructions stored in the memory of the computing device. No intervention is needed in respect of the mechanical elements of the apparatus.

For this reason, research into the rolling up conditions which are best adapted to every type of product can be carried out without difficulty.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A method of forming rolls from strips of compressible material, comprising:

continuously transporting the strip of material into a restricted space defined by at least three elements driven with a movement which causes the strip to be rolled onto itself;

successively contacting the strip with each of these element such that rolling up of said strip occurs;

varying a position of one of the elements to direct the rolling process during the successively contacting step;

controlling the position varying step in accordance with a predetermined program as a function of the length of the strip rolled up, in such a way as to produce a predetermined thickness, which may vary during the course of the rolling up of said strip according to a predetermined algorithm, whereby said strip is uniformly compressed over a predetermined length of said strip.

2. A method according to claim 1, wherein the controlling step comprises:

using the initial thickness of the strip to be rolled as a parameter in said predetermined program.

3. A method according to claim 1, wherein said controlling step comprises:

selecting an algorithm which produces at most an equal thickness in the turns or a thickness which slightly decreases from the commencement to the completion of the rolling process.

4. A method according to claim 2, wherein said controlling step comprises:

selecting an algorithm which produces at most an equal thickness in the turns or a thickness which slightly decreases from the commencement to the completion of the rolling process.

5. An apparatus for forming rolls for strips of compressible material, comprising:

an assembly of at least three elements defining a space in which said strip is subjected to a rolling process wherein said strip is rolled up into a roll;

means for driving said elements such that upon contact therewith, the strip is adapted to be rolled onto itself within the space defined by said elements, at least one element being movable in relation to the others during the course of the operation;

motor means for displacing said movable element;

control means for controlling said motor means;

plural sensors for monitoring the formation of said roll; and computing means having a memory and operative according to a predetermined program stored in said memory for processing measurement signals produced by said sensors to derive thickness signals applied to said control means to control the thickness of said strip during rolling as a function of the length of the strip rolled up so as to produce a predetermined thickness which may vary according to a predetermined algorithm whereby said strip is uniformly compressed over the length of said strip.

6. An apparatus according to claim 5, wherein said at least three elements defining the space in which the rolling process takes place comprise:

a first conveyor on which a belt is transported as far as said space;

a second conveyor disposed at an end of and apart from the first conveyor and forming an acute angle with said first conveyor;

a compression roller situated in the acute angle defined by the first and second conveyors, said compression roller constituting the element which is displaced during the course of the rolling process.

7. An apparatus according to claim 6, wherein said motor means comprises:

an arm supporting said compression roller; and hydraulic jack means for producing a displacement in said arm.

8. An apparatus according to claim 7, comprising:

a position coder rigid with the arm supporting the compression roller for transmitting to the computing means signals indicative of the position of said arm, which signals constitute one of the parameters employed in deriving said thickness signals to determine the operation of the motor means.

9. An apparatus according to one of claim 8, wherein said sensors comprise:

means for detecting a length of the felt already rolled up, whereby the commencement of introduction of the strip into the space in which rolling takes place is established; and means for measuring the time after commencement of introduction of the strip and the speed of travel of the strip.

10. An apparatus according to claim 9, wherein said computing means processes the angular displacement of the arm during the course of roll forming and to that end is programmed so that the angle A of the arm with a vertical axis satisfies the relationship:

$$A = \arccos\left[(L^2 + r^2 + a^2 + b^2 - R^2)/2\sqrt{(L^2 + r^2)(a^2 + b^2)} + \arctan b/a + \gamma\right]$$

in which the symbols employed are respectively:

R: radius of the roll already formed.

r: radius of the compression roller.

L: length of the arm between the axis of rotation and of the compression roll, a: H+h−R, b: R cotg $\alpha/2$−D, $\gamma$: arc tan r/L, H+h: distance from the axis of rotation to a belt of the first conveyor, D: distance separating the point of convergence of the direction of the faces of the first and second conveyors and the projection of the center of rotation of the arm on the face of the first conveyor, and $\alpha$: acute angle formed between the first and second conveyors.

* * * * *